US006427289B2

(12) United States Patent
Flanz

(10) Patent No.: US 6,427,289 B2
(45) Date of Patent: Aug. 6, 2002

(54) TOOL HANDLE CONNECTION SYSTEM AND APPARATUS, AND METHODS OF MAKING AND USING SAME

(76) Inventor: Anthony Flanz, 25350 Branchaster, Farmington Hills, MI (US) 48336

( * ) Notice: Subject to any disclaimer, the term of this patent is extended or adjusted under 35 U.S.C. 154(b) by 0 days.

(21) Appl. No.: 09/804,545

(22) Filed: Mar. 12, 2001

Related U.S. Application Data

(63) Continuation-in-part of application No. 09/443,820, filed on Nov. 19, 1999, now abandoned.

(51) Int. Cl.[7] ..... A46B 9/10; A46B 15/00; B25G 3/12

(52) U.S. Cl. ..... 16/433; 16/DIG. 4; 16/DIG. 40; 15/143.1; 15/159.1; 403/383

(58) Field of Search ..... 16/436, DIG. 4, 16/DIG. 40; 15/143.1, 159.1, 171, 189; 403/3, 299, 383, 343, 296, 292, 274, 278

(56) References Cited

U.S. PATENT DOCUMENTS 4,792,256 A * 12/1988 Batchelor ..... 403/296
5,502,862 A * 4/1996 Vosbikian ..... 15/159.1 X
5,890,254 A * 4/1999 Courtney et al. ..... 15/159.1 X
6,219,883 B1 * 4/2001 Keichline ..... 16/110.1 X

* cited by examiner

*Primary Examiner*—Lynne H. Browne
*Assistant Examiner*—John Cottingham
(74) *Attorney, Agent, or Firm*—Carrier, Blackman & Associates, P.C.; Joseph P. Carrier; William D. Blackman

(57) ABSTRACT

A tool handle connection system and apparatus includes an elongate metal tube, and a connection member. The connection member has one attachment end thereof fitted in an end of the metal tube, and an opposite, threaded end axially projecting from the metal tube and connection member assembly. The metal tube is crimped around the attachment end of the connection member, and the threaded end of the connection member includes self-tapping screw threads and a rotation preventing member is connected to a tip portion to the threaded end after it is inserted through a broom head or the like to prevent the handle from rotating relative to the broom head once it is attached thereto. The connection member includes at least one flat region engaged by a crimped portion of the end of the elongate metal tube. The connection member preferably includes a means for reinforcing axial retention of the metal tube and a stopper means for limiting insertion of the attachment end into the metal tube.

20 Claims, 4 Drawing Sheets

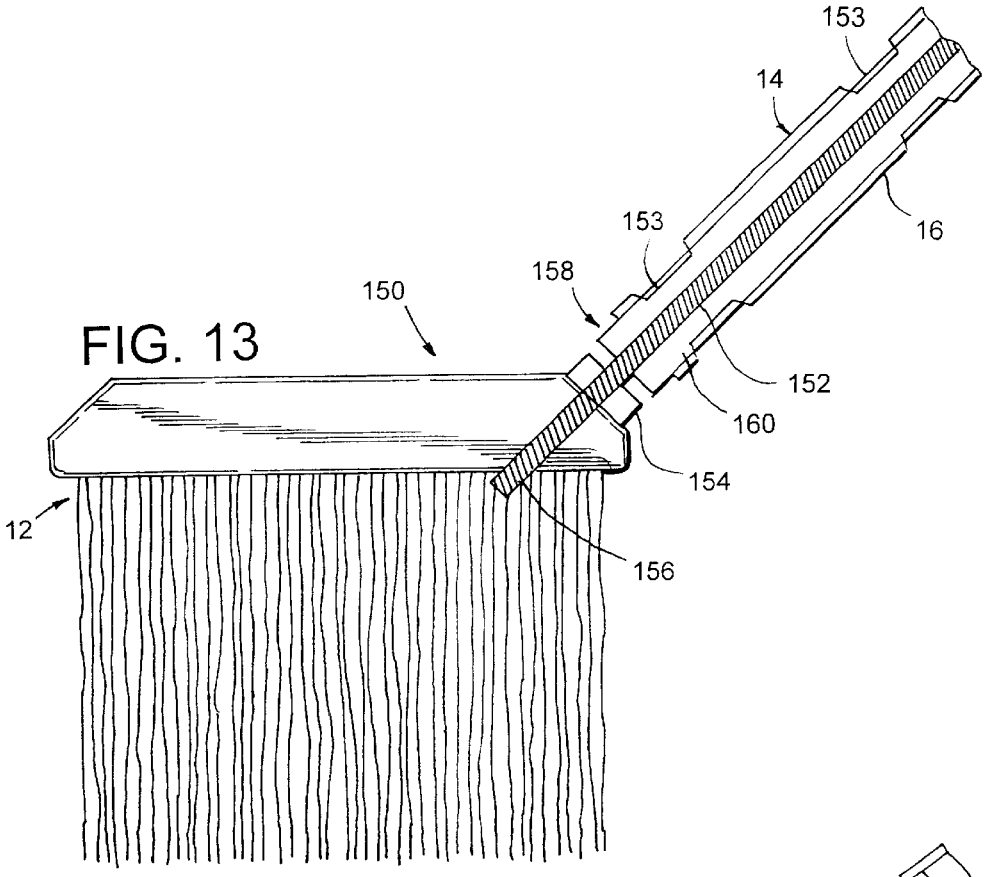
FIG. 13
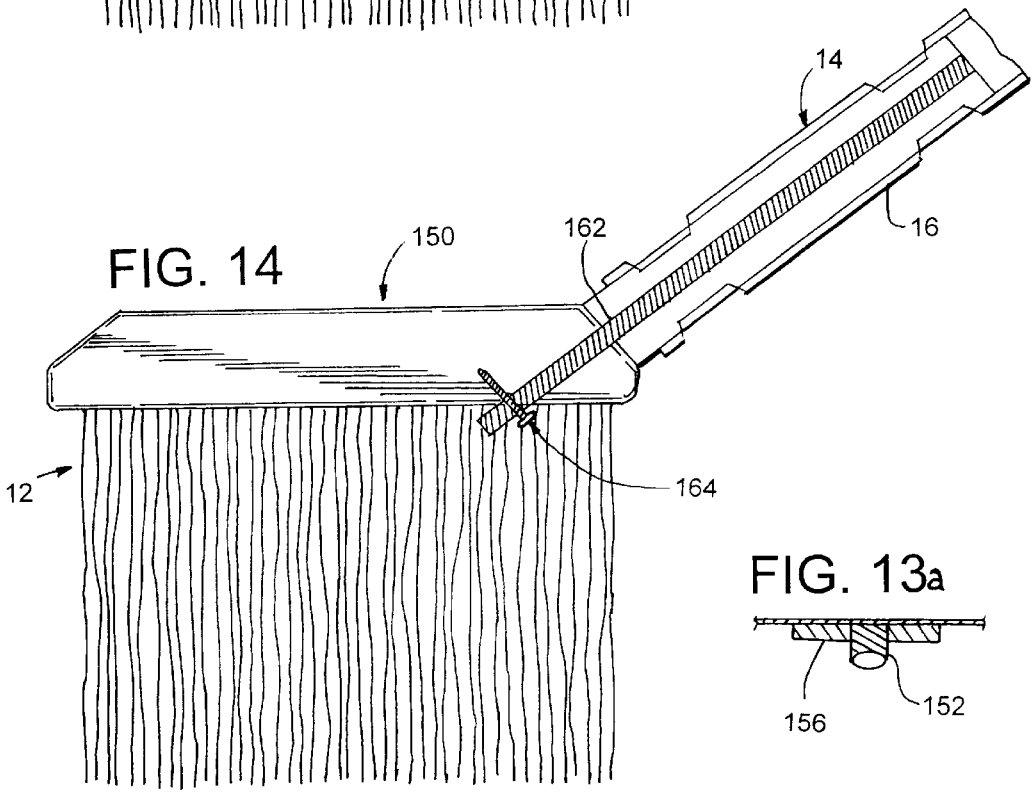
FIG. 14
FIG. 13a

TOOL HANDLE CONNECTION SYSTEM AND APPARATUS, AND METHODS OF MAKING AND USING SAME

This application claims continuation-in-part (CIP) priority under 35 USC §120 from U.S. patent application Ser. No. 09/443,820, filed Nov. 19, 1999 (abandoned).

BACKGROUND OF THE INVENTION

1. Field of the invention

The present invention relates to a tool handle connection system and apparatus. More particularly, the present invention relates to such an apparatus which connects a tool handle to a broom head or other tool head, such that the tool handle is fixed axially and rotationally in relation to the tool head.

2. Description of the Relevant Art

Some types of tool handle connection systems and apparatus are known for fixedly attaching a tool handle to a tool head. Some of the known systems include a tool handle with threads formed on the exterior surface of one end, which end is screwed into a corresponding internally threaded aperture in a tool head. Some other known systems include a stud fixedly attached onto a tool head, which is screwed into a corresponding internally threaded aperture within a tool handle. This invention focuses on systems of the first type, since systems of the first type are much more common, and systems of the second type are difficult to use with metal tool handles.

Although providing a simple connection system, tool handles attached with systems of the first type have several shortcomings. These systems have a tendency to fail within a relatively short time. With such systems, the tool handle tends to rotationally unscrew with use. When the tool handle becomes partially unscrewed, the stress on the connection threads greatly increases. Typically, such threads shear off from the handle, requiring handle replacement, or shear off from the tool head, making the tool inoperable for its intended use.

On many such systems used, for example with conventional push brooms, the tool head includes an alternate threaded aperture. The additional threaded aperture can prolong tool life when the primary threaded aperture becomes degraded. Such a design, however, weakens the structural integrity of the tool head and often results in tool heads breaking with use.

Another example of a known tool handle connection system and apparatus is U.S. Pat. No. 4,285,096, issued in 1981 to Swaim, and entitled "INDESTRUCTIBLE HANDLE FOR MOP OR BROOM AND METHOD OF MAKING SAME." The Swaim patent discloses a handle which is constructed so that it either may be placed on a mop head, with a female thread formed in a plug thereof screwing onto a stud which is fixedly attached to the mop head, or may be screwed into the internally threaded aperture of a standard push broom head. The handle disclosed by Swaim includes a tubular steel handle member, with a plastic or vinyl sleeve on the outside of the steel handle. A solid steel plug is disposed in an end of the tubular member, and a part of the plug extends outwardly from the end of the steel tube, and has male threads formed on the exterior side surface thereof. The steel tube is crimped in place around the plug, and is then optionally spot welded to the plug for extra help.

Although providing a handle connection apparatus which may be attached using the first connection system, the Swaim patent fails to address problems created by tool handles partially unscrewing with use. Additionally, the primary crimping attachment method disclosed by Swaim allows for the tubing to unscrew from the plug, since the tubular handle member is crimped onto a threaded surface of the plug.

In order to compensate for the handle unscrewing from the plug, Swaim includes the option of spot welding the handle to the plug. Crimping as well as spot welding creates a connection apparatus which is not simple nor easy to use. Spot welding still does not address the problem of a tool handle partially unscrewing from a tool head with use.

Although making an improvement over the conventional systems and apparatus for connecting tool handles to tool heads, the Swaim disclosure doesn't entirely fill the needs of the industry. A need still exists in the art for a tool handle connection system and apparatus which is simple and easy to manufacture and use, highly durable, and which axially and rotationally fixes a tool handle to a tool head.

SUMMARY OF THE INVENTION

The present invention has been developed to overcome the foregoing limitations and disadvantages of known tube tool handle connection systems and apparatus, and to generally fulfill a need in the art for a tool handle connection system and apparatus which is simple and easy to manufacture and use, highly durable, and which axially and rotationally fixes the tool handle to the tool head.

According to the invention there is provided a tool handle including an elongate metal tube, and a connection member. The connection member has one attachment end thereof fitted in an engagement end of the metal tube, and an opposite, threaded end, axially projecting from the metal tube and connection member assembly. The metal tube is crimped around the attachment end of the connection member, and the threaded end of the connection member includes self-tapping screw threads. Self-tapping screw threads are desirable since they are difficult to unscrew compared with large threads found in some conventional tool attachment systems.

In order to prevent rotation of the tool handle relative to the connection member, the connection member includes at least one, and preferably two, flat regions engaged by a crimped portion of the end of the elongate metal tube.

The connection member preferably includes a means for reinforcing axial retention of the metal tube. Such means may include an interference fit between the connection member and the metal tube, scored surface areas on the connection member, or annular rings on the connection member.

It is further preferable that the connection member includes a stopper means for limiting insertion of the attachment end into the metal tube. It is further preferable, that the cross-sectional area of the attachment end of the connection member tapers down from a point intermediate along the longitudinal axis of the connection member, to a point at the end of the attachment end to act as a stopper means. Alternatively, such insertion may be limited by an annular flange having an outer diameter larger than the outer diameter of the elongate tube, located at an intermediate point along the connection member.

In an alternative configuration of the invention, the tool handle further includes a plastic insert band fixedly crimped within the engagement end of the elongate tube. Additionally, the attachment end of the connection member includes a standard screw head having flat regions peripherally therearound, which are engaged by crimped portions of the engagement end of the elongate metal tube. The band reinforces attachment of the connection member to the metal tube, and reduces the potential of wobble between the connection member and the metal tube.

It is an object of the present invention to provide a tool handle connection system and apparatus which axially and rotationally fixes a tool handle to a tool head.

Another object of the present invention is to provide a tool handle connection system which is highly durable, as well as simple and easy to manufacture and use.

For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 13 is a cut-away side view of a tool attachment system and apparatus in accordance with the fifth preferred embodiment.

FIG. 13*a* is a front elevational view of the tip end portion of the bolt and rotation preventing means of FIG. 13 rotated 90 degrees from the view in FIG. 13.

FIG. 14 is a cut-away side view of a tool attachment system and apparatus in accordance with the sixth preferred embodiment.

DETAILED DESCRIPTION OF THE PREFERRED EMBODIMENTS

Figure 1:
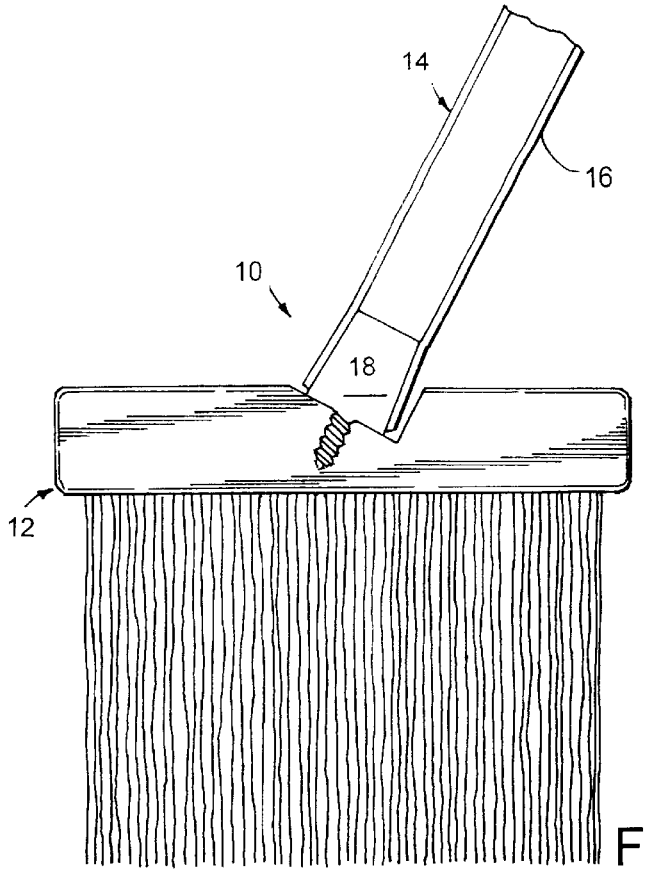
FIG. 1 is a cut-away side view of a tool attachment system and apparatus in accordance with the first preferred embodiment.
Figure 2:
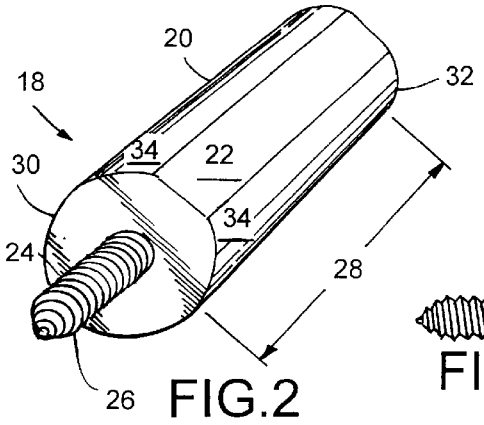
FIG. 2 is a perspective view of a connection member of a tool attachment system and apparatus in accordance with the first preferred embodiment of the present invention.
Figure 3:
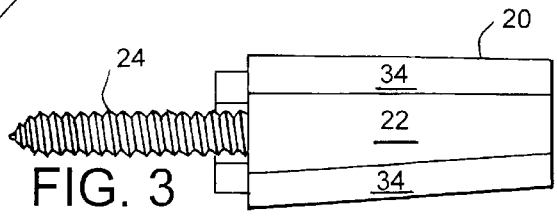
FIGS. 3–5 are top, side, and end views, respectively, of a connection member of a tool attachment system and apparatus in accordance with the first preferred embodiment of the present invention.
Figure 5:
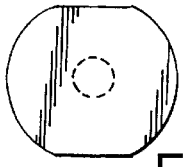
Figure 4:
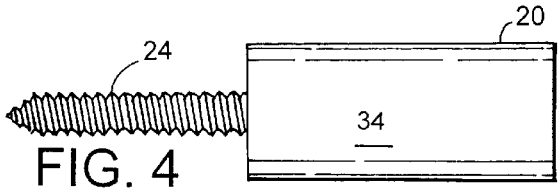

Referring to FIG. 1, there is shown a tool handle connection system and apparatus according to the first preferred embodiment of this invention, for attaching a tool handle to a tool head, embodied herein as a broom. The broom 10 generally includes a broom head 12 and a tool handle apparatus 14. The tool handle apparatus generally comprises an elongate tube 16 and a connection member 18.

Referring to FIGS. 2–5, the connection member 18 generally includes an attachment end 20, having opposed flat portion 22, and a threaded end 24, having self-tapping screw threads 26. The attachment end length 28 is approximately 1"–3", and has a substantially circular cross-section. The attachment end preferably tapers down from an intermediate surface 30 along the longitudinal axis of the connection member 18, to an endpoint 32 of the attachment end. The outer diameter of the attachment end at the intermediate surface 30 is larger than the outer diameter of the elongate tubing. It is preferable that the outer diameter of the elongate tubing 16 is about 1.0", and the outer diameter of the attachment end at the intermediate surface 30 is about 1.1". It is further preferable that the outer diameter of the attachment end at the endpoint 32 is approximately 0.75".

The flat portions 22 are necessary to prevent rotation of the elongate tubing 16 in relation to the connection member 18 when attached thereto. The attachment end 20 preferably includes an opposed pair of flat portions 22, to firmly prevent relative rotation with the elongate tubing, while still maximizing contact between the remaining attachment end arcuate side portions 34 and the inner surface of the elongate tubing 16. The flat portions 22 are preferably about ½" in width.

The threaded end 24 preferably includes a conventional ⅜" self-tapping screw stud approximately 1"–2" in length, with corresponding standard single helix threads 26. Other screw sizes around ⅜"–⅝" may also be used, as well as various self-tapping threads, with varied pitches, multiple helixes, or other varieties.

A self-tapping screw stud within such a size range provides excellent axial retention, and greatly resists backing out or unscrewing. The self-tapping action ensures a secure custom grip of the screw to the engaging portion of the tool head. Unscrewing is common in conventional tool handle attachment systems, which employ tool handles having threads on the outer surface of one end, screwed into an internally threaded aperture of the tool head. The comparatively small screw portion of the threaded end 24 has many more threads to engage the tool head than such a conventional configuration. The multiple engaging threads and their custom fit combine to greatly resist backing out or partially unscrewing.

The connection member 18 is preferably cast as a single unit from a metal such as steel. The attachment end 20 may however, be machined, and the threaded end 24 attached as a stud weldment, or of other analogous construction.

The elongate tube 16 preferably comprises standard 1" steel tubing or conduit, cut to approximately 5 feet in length. The diameter of the tubing may be smaller or larger, depending on desired handle size and desired strength characteristics.

Figure 6:
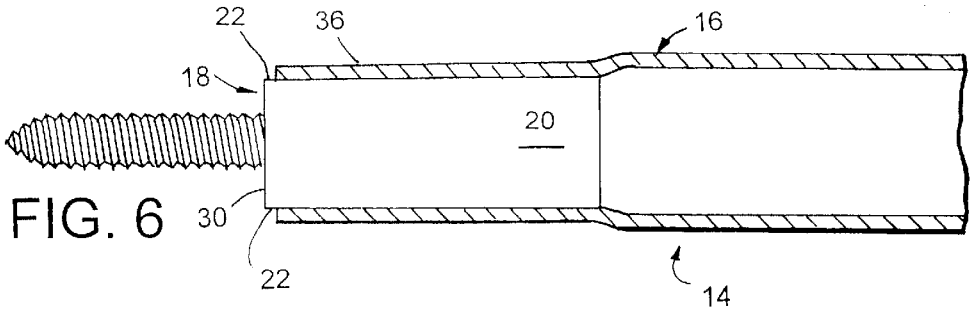
FIG. 6 is a cut-away side view of a connection member fixedly attached to an elongate tube in accordance with the first preferred embodiment of the present invention, showing the metal tube crimped on the two flat regions of the connection member.
Figure 7:
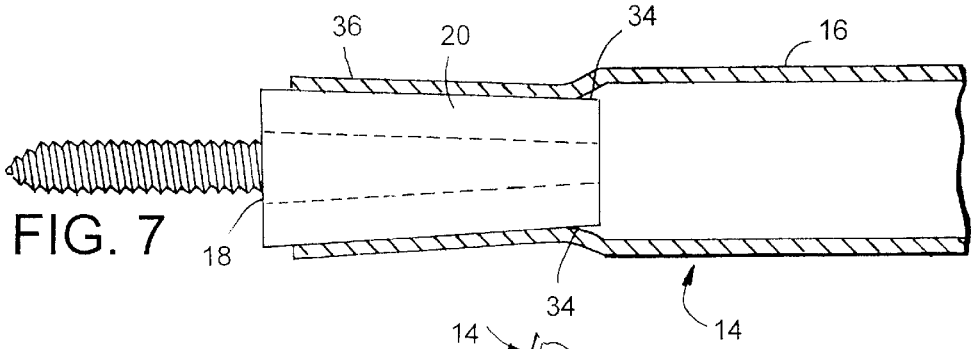
FIG. 7 is a cut-away top view of a connection member showing the tapered portion of the connection member in accordance with the first preferred embodiment of the present invention.

Referring to FIGS. 6 and 7, the tool handle apparatus 14 is formed by fixedly attaching the connection member 18 to the elongate tubing 16. The connection member is attached by inserting the attachment end 20 into an engagement end 36 of the elongate tubing 16 until insertion is limited by the larger outer diameter of the attachment end at the intermediate surface 30. The elongate tube 16 is then crimped around the attachment end 20 of the connection member, engaging the arcuate sides and the flat portions 22.

Figure 8:
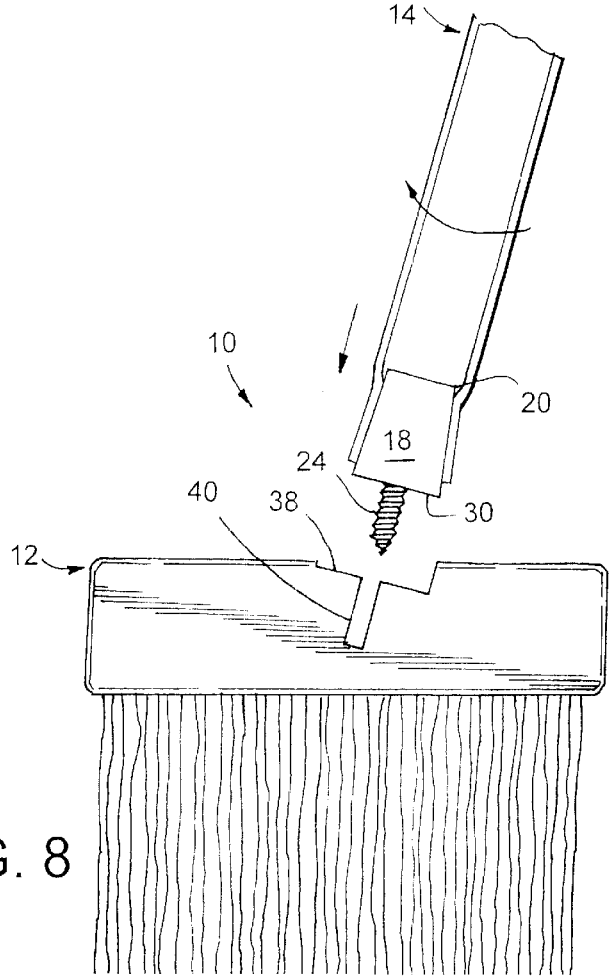
FIG. 8 is a cut-away side view showing attachment of the connection member and tool handle assembly to a tool head in accordance with the first preferred embodiment.

Referring to FIG. 8, the broom 10, or other tool, is formed by fixedly attaching the tool handle apparatus 14, to the broom head 12 as shown. The broom head preferably includes a recess 38 cut into the broom head, which recess sets the angle of the tool handle in relation to the broom head, as well as ensures a flat surface for the intermediate surface 30 of the connection member 18 to firmly abut. It is important for the connection member 18 to firmly abut the broom head, so that forces involved between the tool handle and the broom head will be directly transferred to the broom head at the point of abutment. If the connection member does not firmly abut the broom head, such forces create increased stress concentrations in the threaded end of the connection member, as well as at the points of contact between the screw threads and the broom head, leading to a degraded connection common with conventional attachment systems.

It is desirable that the recess 38 be cut at an angle around 40–50 degrees, most preferably 45–48 degrees, in relation to the tool head, in order to set the tool handle assembly at such an angle. It is further desirable that the recess include an attachment hole 40 perpendicularly drilled into the broom head to the length of the threaded end 24 of the connection member 18. Such attachment hole receives the threaded end of the connection member. It is desirable that the hole be drilled to a diameter standard for the corresponding screw size of the threaded end, typically around ⅛"–¼" for a ⅜–½" size screw stud. The attachment hole 40 guides the desired insertion angle of the tool handle apparatus 14, and prevents splitting of the broom head 12, if a wooden broom head is used.

The tool handle apparatus 14 is fixedly attached by threadingly inserting the threaded end 24 of the connection member 20 into the attachment hole 40 until the intermediate surface 30 of the connection member firmly abuts the broom head recess 38.

Figure 10:
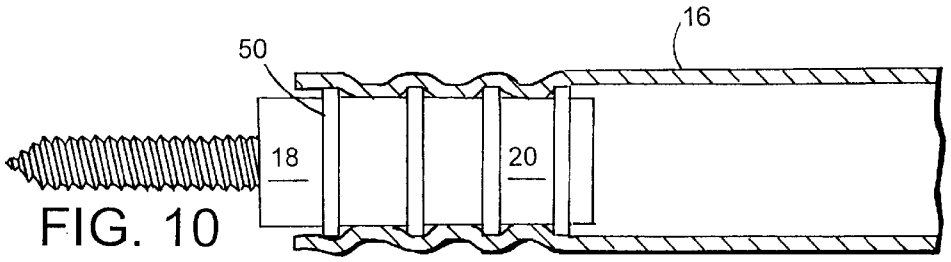
FIG. 10 is a cut-away side view of a connection member attached to a tool handle in accordance with the second preferred embodiment of the present invention.
Figure 9:
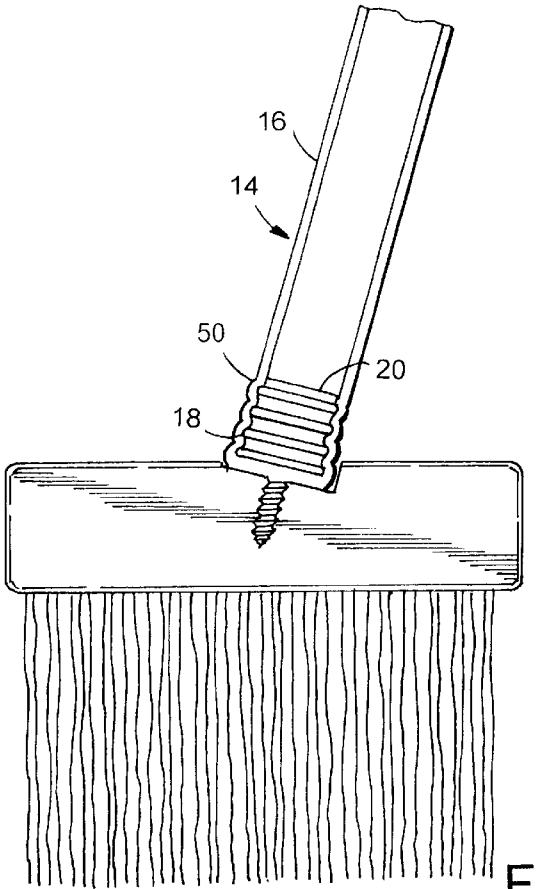
FIG. 9 is a cut-away side view of a tool attachment system and apparatus in accordance with the second preferred embodiment of the present invention, which includes annular rings to reinforce axial retention of the tool handle to the connection member.

Referring to FIGS. 9 and 10, a tool handle apparatus and assembly is shown according to the second preferred embodiment of the invention. The second preferred embodiment includes reinforcing axial retention means embodied as annular rings 50 around the attachment end 20 of the connection member 18. Except for preferences and aspects related to the annular rings 50, all other preferences and aspects are the same as the first preferred embodiment.

The annular rings 50 reinforce axial retention of the elongate tube 16 in relation to the connection member 18, by forcing the elongate tube to form around such annular rings when crimped around the connection member. The annular rings are not connected to each other in a threaded arrangement, but are independently separate and are perpendicular to the longitudinal axis of the elongate tube.

Figure 11:
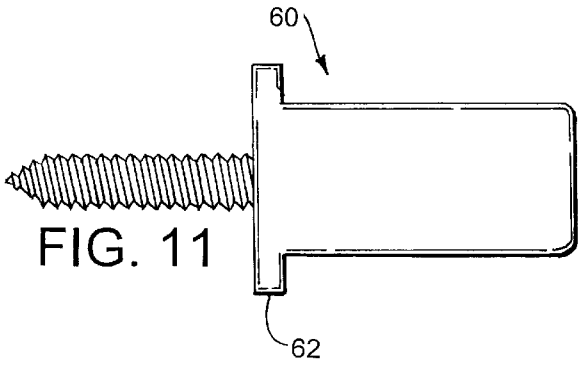
FIG. 11 is a side view of a connection member having an annular flange as a stopper means in accordance with the third preferred embodiment of the present invention.

Referring to FIG. 11, a connection member 60 of a tool handle apparatus is shown according to the third preferred embodiment of the invention. The connection member includes a stopper means embodied as an annular flange 62, as opposed to tapering of the attachment end 20 of the connection member 18 as embodied in the first preferred embodiment. Except for preferences and aspects related to the annular flange 60, all other preferences and aspects are the same as the first preferred embodiment.

The annular flange 62 has a larger outer diameter than the outer diameter of the elongate tube 16, thus limiting insertion of the attachment end. The annular flange outer diameter is preferably around 1.5", but could be larger to further reduce stress between the tool handle apparatus and the tool head.

Figure 12A:
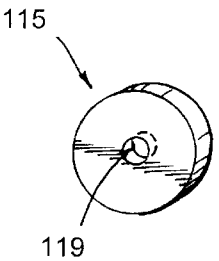
FIG. 12*a* is perspective view of the plastic insert band in accordance with the fourth preferred embodiment of the present invention.
Figure 12:
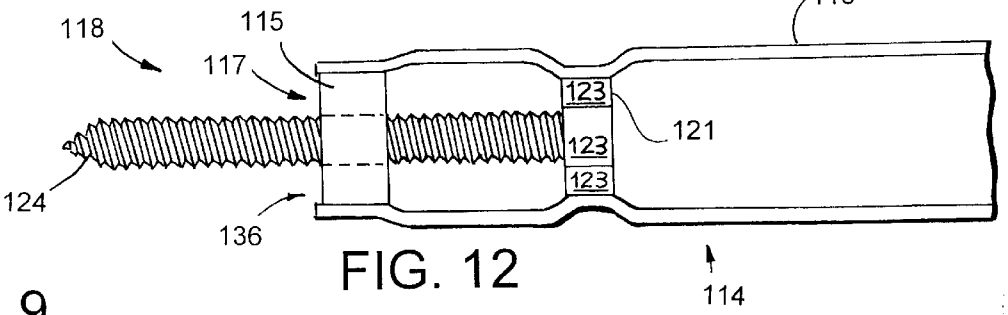
FIG. 12 is a cut-away side view of a connection member attached to a tool handle in accordance with the fourth preferred embodiment of the present invention.

Referring to FIGS. 12 & 12*a,* there is shown a tool handle connection member and apparatus according to the fourth preferred embodiment of the invention. In this embodiment, the tool handle apparatus 114 further includes a plastic insert band 115 fixed with the engagement end 136 of the elongate tube 116, which band 115 operatively cooperates with an intermediate portion 117 of the connection member 118. The attachment end 120 preferably includes a screw head 121 having flat regions 123 peripherally located therearound. Except for preferences and aspects related to the plastic insert band 115, and the screw head 121, all other preferences and aspects are the same as the first preferred embodiment.

The plastic insert band 115 is located within the engagement end 136 of the elongate tube 116, and is preferably fixed to the tube through the use of crimps. Crimps are desirable in order for the elongate tube 116 to compressingly engage the plastic insert band 115, and thereby create a force fit. Although it is preferable that the band 115 is made from plastic, it can also be made from a hard rubber material or other such compressible material.

As shown in FIG. 12*a,* the insert band 115 preferably includes a set hole 119 through which the threaded end 124 of the connection member 118 is threaded until an intermediate portion 117 of the connection member is circumscribed by the insert band. The insert band cooperates with the attachment end 120 of the connection member 118 to maintain desired alignment of the connection member relative to the elongate tube 116, as well as to reinforce attachment of the connection member to the elongate tube, and to prevent wobble therebetween. As shown, the insert band may not extend between the intermediate portion 117 of the connection member to the screw head 121; however, it is appreciated that the band may be as wide as desired and may extend fully therebetween in order to provide additional support.

The attachment end 120 of the connection member 118 includes a screw head 121 having a plurality of flat regions 123. The elongate tube 116 engages the flat regions 123 by means of crimps therearound. Engagement of the flat regions 123 prevents rotation of the connection member relative to the elongate tubing 116.

Referring to FIGS. 13 and 13*a,* there is shown a tool handle connection system and apparatus according to the fifth preferred embodiment of this invention, for attaching a tool handle to a tool head, embodied herein as a broom. The broom includes a broom head 12 and a tool handle apparatus 14. The tool handle apparatus generally comprises an elongate tube 16 and a connection member 158. The connection member 158 consists of an elongate stopper 160, flat-ended machine bolt or threaded shaft 152, a nut or locknut 154, and a rotation preventing device 156. The stopper 160 may be the same as the stopper 20 in FIG. 7, although it is preferably an elongate plastic member with a uniform diameter. The bolt or shaft 152 may, for example, be approximately 8"–11" long and in various diameters, e.g., ⅜", 7/16" or ½" OD, depending on the severity of intended use, with approximately 2"–3" projecting from the end of the stopper 160. The rotation preventing device 156 may be a clevis pin with a point inserted completely through an opening formed through a tip end of the bolt as shown. Further, the connection member 158 involves formation of crimps 153 for fixing the tube 16 about the stopper 160 and bolt 152. Preferably at least two crimps 153 will be formed, one near each end of the stopper 160, although additional crimps could also be formed. The length of the bolt or shaft is significant because the connection member having such length is very strong and stable, such that there is no need for use of a conventional stabilizing device as are often used with broom handles. For attaching the tool handle apparatus 14 to the broom head 12, an opening with a diameter slightly larger than the OD of bolt 152 is drilled through the upper portion of the broom head 12, extending diagonally from an upper edge (at a longitudinal center of the head 12) down through the lower face of the upper portion, the portion of the bolt 152 extending from the stopper 160 is inserted through the diagonal opening in the broom head and the clevis pin 156 is inserted through the opening formed through the tip end of the clevis pin 156, as shown. The nut 154 is rotated toward the tip end of the bolt 152, whereby the upper portion of the broom head 12 is tightly engaged between the nut 154 and the pin. In this condition the pin 156 tightly engaging the broom head prevents the bolt 152 from rotating relative to the broom head, and thus the handle apparatus 14 remains firmly attached to the broom head. Specifically, because the handle device 14 is disposed at an angle of 40–50 degrees (preferably 45–48 degrees) relative to the broom head, while the clevis pin extends straight across the tip end of the bolt 152 parallel to the lower surface of the broom head, if a counter-clockwise torque is applied to the handle device 154, the handle cannot rotate and hence become loose relative to the broom head because the clevis pin 156 simply digs into the broom head preventing rotation of the handle.

As shown, there is preferably a gap between the nut 154 and the end of the stopper 160 for the purpose of tightening the nut. Optionally, a cover (not shown) may be provided around the nut 154 and the gap area between the nut and the stopper 160 for appearance.

Although the clevis pin is depicted as the rotation preventing means in FIG. 13, it will be understood that other members could be used to achieve the same effect, e.g., a nail, a screw, a rivet, a cotter pin, etc. Also, the nut 154 could be omitted.

Referring to FIG. 14, there is shown a tool handle connection system and apparatus according to the sixth preferred embodiment of this invention, for attaching a tool handle to a wooden tool head, embodied herein as a broom. The sixth embodiment is the same as the fifth embodiment except that a self-tapping screw 162 is used instead of the machine bolt or threaded shaft 152, and correspondingly the nut 154 is also omitted, and in that a screw 164 is used as the means for preventing rotation of the handle, instead of the clevis pin 156. The screw 164 extends completely through an opening formed in the tip end of the self-tapping screw 162 and then into the wooden broom head. Also, while an opening is pre-formed in the broom head for insertion of the self-tapping screw 162, the pre-formed opening will have a diameter which is slightly less than that of the screw 162 so that the screw is firmly engaged in the broom head after being screwed therein.

Although there have been described what are at present considered to be the preferred embodiments of the invention, it will be understood that variations and modifications may be made thereto without departing from the gist, spirit or essence of the invention.

I claim:

1. A tool handle comprising:

an elongate member with a metal end;

a connection member having an attachment end thereof fixed with said metal end, and an opposite, threaded end projecting from said metal end, said threaded end having an opening defined in a tip portion thereof;

a rotation preventing means operatively associated with said tip portion to prevent said elongate member from turning relative to a tool when attached to the tool;

said threaded end of said connection member is adapted to be operatively engaged with the tool such that the threaded end extends though a portion of the tool and said tip portion of the threaded end projects from the tool;

said rotating preventing means comprising an engagement member which extends through said opening, and an adjustable member disposed with an intermediate portion of said connection member and engaging the tool such that the portion of the tool is fixed on the threaded end between the rotation preventing member and the adjustable member; and said metal end of said elongate member is crimped about said attachment end of said connection member.

2. A tool handle as recited in claim 1, wherein said attachment end of said connection member further includes at least one flat region engaged by a crimped portion of said metal end of said elongate member.

3. A tool handle as recited in claim 2, wherein said attachment end is substantially cylindrical with two flat portions on opposite sides thereof.

4. A tool handle as recited in claim 1, wherein connection member is metal rod, said attachment end is from five inch to nine inches in length, and said metal end of said elongate member is crimped at multiple, spaced portions along the length of said attachment end.

5. A tool handle as recited in claim 1, wherein said threaded end is from one inch to three inches in length.

6. A tool handle as recited in claim 1, wherein said attachment end of said connection member further comprises a plastic member disposed coaxially therearound, said plastic member having an outer diameter which is approximately the same size as an inner diameter of said metal end of said elongate member, said attachment end together with said plastic member being disposed within said metal end.

7. A tool handle as recited in claim 1, wherein said attachment end of said connection member further comprises means for reinforcing axial retention of said metal end crimped on said connection member, including at least one annular ring disposed about a portion of said attachment end.

8. A tool handle as recited in claim 1, said threaded end of said connection member is self-tapping.

9. A tool handle as recited in claim 1, wherein said connection member further includes a stopper means for limiting insertion of said attachment end of the connection member into said metal end of the elongate member.

10. A tool handle as recited in claim 9, wherein said stopper means comprises an annular flange at an intermediate point between said threaded end and said attachment end of the connection member, said annular flange having an outer diameter larger than the outer diameter of said metal end.

11. A broom comprising:

a broom head; and a tool handle comprising:

an elongate member with a metal end; and a connection member having an attachment end thereof fixed with said metal end of said elongate member, and an opposite, threaded end projecting from said metal end of said elongate member;

said metal end of said elongate member is crimped about said attachment end of said connection member;

said threaded end of said connection member fixedly engages said broom head with a tip portion of said threaded end projecting away from said broom head;

said projecting tip portion of said threaded end having an opening defined therethrough; and a rotation preventing member which extends through said opening in said tip portion and operatively engages said broom head to prevent said handle from turning relative to the broom head when attached to the broom head.

12. A broom as recited in claim 11, said broom head including a shallow recess defined in an upper surface thereof, wherein an end surface of said metal end of the elongate member flushly engages a bottom surface of said recess, and said threaded end of said attachment member penetrates said broom head through a center of said recess.

13. A broom as recited in claim 12, said broom head further including a starter hole drilled therein, defined in the center of said recess, wherein said threaded end of said connection member engages said starter hole.

14. A tool handle as recited in claim 1, wherein said adjustable member is a threaded nut rotatably engaged with said threaded end, and when said threaded nut is rotated toward the tool it draws the engagement member into firm engagement with a surface of the tool to prevent rotation of the elongate member relative to the tool.

15. A tool handle as recited in claim 1, wherein said engagement member is substantially linear.

16. A tool handle as recited in claim 4, wherein said attachment end of said connection member further comprises a plastic member disposed coaxially therearound, said plastic member having an outer diameter which is approximately the same size as an inner diameter of said metal end of said elongate member, said attachment end together with said plastic member being disposed within said metal end.

17. A tool handle as recited in claim 11, wherein said connection member is a metal rod, said attachment end is from five inch to nine inches in length, and said metal end of said elongate member is crimped about said attachment end at multiple, spaced portions along the length of said attachment end.

18. A tool handle as recited in claim 17, wherein said attachment end of said connection member further comprises a plastic member disposed coaxially therearound, said plastic member having an outer diameter which is approximately the same size as an inner diameter of said metal end of said elongate member, said attachment end together with said plastic member being disposed within said metal end.

19. A tool handle as recited in claim 11, further including a threaded nut rotatably disposed with said threaded end and engaging the broom head such that the broom head is secured on the threaded end between the rotation preventing member and the nut.

20. A tool handle as recited in claim 16, wherein an outer diameter of said metal end of said elongate member is at least twice as large as an outer diameter of said threaded end of said connection member.

* * * * *